United States Patent [19]

Rouly et al.

[11] Patent Number: 4,520,726

[45] Date of Patent: Jun. 4, 1985

[54] FLAT SILK-SCREEN PRINTING MACHINE WITH MOVABLE PIVOTED SUPPORT

[75] Inventors: Eric Rouly; Philippe Baquet; Jean-Louis Dubuit, all of Paris, France

[73] Assignee: Societe d'Exploitation des Machines Dubuit, Paris, France

[21] Appl. No.: 434,860

[22] Filed: Oct. 18, 1982

[51] Int. Cl.[3] ..... B41L 13/02; B41F 15/26

[52] U.S. Cl. ..... 101/123; 101/126; 271/267; 414/598

[58] Field of Search ..... 101/114, 123, 124, 126; 414/598, 728; 271/267, 273, 274

[56] References Cited

U.S. PATENT DOCUMENTS

| | | | |
|---|---|---|---|
| 1,504,034 | 8/1924 | Erwin | 414/598 |
| 1,815,021 | 7/1931 | Bland | 101/123 |
| 2,039,909 | 5/1936 | Kem | 101/123 |
| 2,664,066 | 12/1953 | Martin | 101/126 |
| 2,991,711 | 7/1961 | Ehrhard | 101/123 |
| 3,795,189 | 3/1974 | Jaffa | 101/126 |
| 4,411,586 | 10/1983 | Zitser | 414/728 |

FOREIGN PATENT DOCUMENTS

| | | | |
|---|---|---|---|
| 145376 | 6/1951 | Australia | 101/126 |
| 2488833 | 2/1982 | France | 101/123 |
| 774764 | 5/1957 | United Kingdom . | |
| 1237331 | 6/1971 | United Kingdom . | |
| 1564003 | 4/1980 | United Kingdom | 101/DIG. 12 |

*Primary Examiner*—Clyde I. Coughenour

*Attorney, Agent, or Firm*—Charles A. Brown; Charles E. Brown

[57] ABSTRACT

A 'flat' silk-screen printing machine is disclosed wherein the table is reciprocably displaced along an inclined table support between a raised, advanced, printing position wherein the table is parallel to and immediately below a horizontal screen and a lowered, retracted, access position in which the table is inclined and extends forwardly of the inclined table support so that the greater part of the table protrudes outwardly of the machine, thereby providing enhanced access for positioning and removing the substrate to be printed. The table is pivotally mounted on the inclined table support and pivoted by a combination of a linkage and fluid cylinder and is attached to a belt running along the inclined table supported for translation up and down the same.

11 Claims, 4 Drawing Figures

FLAT SILK-SCREEN PRINTING MACHINE WITH MOVABLE PIVOTED SUPPORT

BACKGROUND OF THE INVENTION

The present invention relates to 'flat' silk-screen printing machines wherein the image is applied to a substrate lying flat in a manner well-known in itself by means of an ink-applying blade and an ink-wiping blade or doctor, the ink-applying blade spreading the ink on a screen before transfer and the ink-wiping blade transferring the ink by image from the screen to the substrate to be printed.

PRIOR ART

In some silk-screening printing machines the substrate to be printed is placed on a fixed horizontal table and the silk-screen which overlies the table is carried on a frame pivotally mounted between a printing position in which the screen is parallel to and in the immediate vicinity of the substrate, and a raised position in which the operator has access to the substrate for its removal.

In the foregoing type of silk-screen printing machine the ink has a tendency to collect at the lower part of the screen in the inclined position thereof which frequently causes defects in the printed image. Further, the operator encounters difficulties when positioning the substrate to be printed on the table. In the first place, since the table is fixed and horizontal thin substrates which by their very configuration are difficult to handle are not easily brought to the right position. Second of all, the pivoted frame in the raised position does not provide adequate clearance whereby access to the table is difficult.

In other silk-screen printing machines the silk-screen also overlies the table and is associated with a vertically movable frame displaceable between a raised position and a lowered position while the table which carries the substrate is horizontal and moveable in translation between an advanced position in vertical alignment with the silk screen and a retracted position in which it at least partially clears the machine.

It will be understood that in the retracted position of the latter machine the table is more accessible than in the former machine. Still the horizontal position of the table is a source of the aforementioned drawback, namely, the difficulties for the operator during the positioning of the substrate on the table thereby requiring that the operator take various time-consuming steps which, naturally, increase operating costs.

In other machines the silk screen is associated with a fixed horizontal frame whereas the table for receiving the substrate is disposed below the screen and is pivotally mounted between a horizontal printing position and an inclined position in which the operator can introduce a substrate to be printed or remove a printed substrate. In this type of machine the inclined position of the table facilitates the introduction and removal of the substrate. On the other hand, the accessibility of the table is still not good since the table is strictly in vertical alignment with the screen carrying frame.

It follows from the foregoing that such present-day silk-screen printing machines are not devoid of drawbacks, namely, the difficulties of introducing and positioning the substrate to be printed and removing the printed substrate.

SUMMARY OF THE INVENTION

According to the present invention there is provided a flat silk-screen printing machine which improves accessibility for introducing and removing the substrate.

According to the invention there is provided a silk-screen printing machine for printing substrates lying flat wherein a machine frame supports a screen in a substantially horizontal position, an ink-applying blade and an ink-wiping blade being moveably mounted on the machine frame for alternately sweeping across the screen, and a flat table for receiving a substrate to be printed. The improvement comprises an inclined table support, the table being reciprocably mounted on the inclined table support for movement along the table support; means for pivotally mounting the table on the table support; means for controlling movement of the table between a raised, advanced, printing position in which the table is parallel to and immediately below the screen, and a lowered, retracted, access position for introducing and removing the substrate in which the table is inclined and generally extends outwardly of the inclined table support whereby the greater part of the table clears the machine for enhanced access.

According to a preferred embodiment, the table is carried by a table frame, the table support comprising tracks, the table frame being displaceable along the tracks, the means for pivotally mounting the table comprising a pivotal mounting of the table frame about an axis at the rear end of the table frame. Further, the table frame comprises rollers and back-up rollers cooperable with the upper side and under side of the tracks and freely rotatably mounted on front and rear brackets interconnected by transverse bars. Preferably, the pivotal movement of the table is controlled by a fluid cylinder having a cylinder body connected at the rear end of the table frame and a piston rod connected to a link which is pivotally mounted on the front transverse bar and is connected at its end remote from the piston rod at front end of the table frame. Preferably, the means for controlling the movement of the table comprises gears mounted adjacent the opposite ends of the inclined support table, a toothed belt running over and meshing with the gears, the toothed belt being secured to the rear pair of brackets on the table frame.

Such a machine considerably facilitates the handling of substrates and in particular thin substrates requiring handling for positioning on the table. Indeed, since the table in its lowered, retracted, position is accessible practically over its entire surface and is also inclined, the operator can easily position the substrate on the table, owing to the slope of the table the substrate slides downward by itself to abutments which position the substrate correctly.

According to another feature of the invention the ink-applying blade and ink-wiping blade are part of an assembly mounted for movement transversely relative to the direction of displacement of the table along the inclined table support. Preferably, the direction of movement of the assembly is at right angles to the direction of displacement of the table when viewed vertically.

The problem which existed up to now regarding the correct positioning of the substrate on the table is thus overcome since the table in its lowered, retracted position is entirely accessible to the operator and is also inclined.

These and other features and advantages of the invention will be better understood from the description which follows, given by way of example, with reference to the accompanying drawings.

DESCRIPTION OF THE PREFERRED EMBODIMENT

Figure 1:
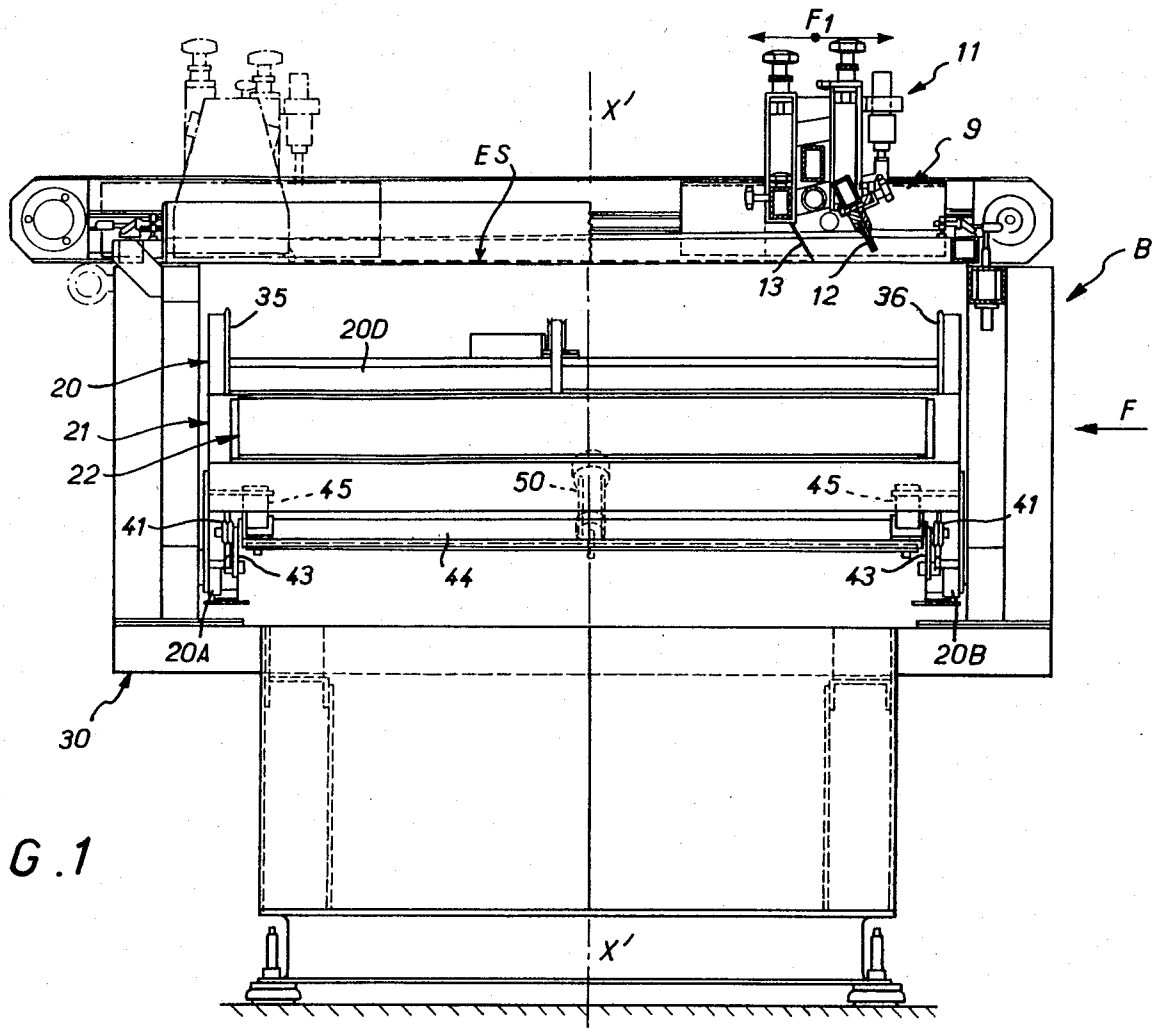
FIG. 1 shows a front elevational view of a flat silk-screen printing machine, the machine being viewed from the operator's working position.

According to the illustrated embodiment there is provided a 'flat' silk-screen printing machine comprising a machine frame generally designated by reference B arranged to support in its upper part an ink wiping and applying assembly 9 transversely moveably mounted along an axis X—X (FIG. 2) and in the direction of arrow F1 (FIG. 1). The machine frame B is also arranged to support a screen frame for carrying a silk screen which is schematically shown at ES.

The foregoing parts are not described in detail herein; they are well known to those skilled in the art and their construction and arrangement does not directly concern the present invention. It need only be specified that the ink applying and wiping assembly 9 comprises two heads 10, 11 carrying the ink-wiping blade 12 and the ink-applying blade 13, respectively, mounted for displacement on tracks 14, 15 disposed on opposite sides of the axis X—X and fixed to the machine frame B. Means such as a hydraulic motor 16 and toothed belt 17 coupled to one of the heads 10, 11, here head 11, are adapted to drive the assembly 9 for reciprocating movement so that the ink-wiping blade or doctor 12 transfers the inked image to the flat substrate whereas the ink-applying blade 13 applies the ink to the flat substrate for the next printing operation.

The flat substrate to be printed is brought into contact with the screen ES by means disposed under the screen. These means comprise, in the illustrated embodiment of the invention, and inclined table support indicated overall by reference numeral 20 and a table frame 21 reciprocably slidingly mounted on the upper side of the table support 20. The table frame 21 is adapted to carry the actual flat table 22 for receiving the substrates to be printed. The table 22 comprises means (known per se and not illustrated) for ensuring the correct position of the substrate thereon. The table frame 21 is mounted for movement along axis X'—X' on the table support 20. When viewed vertically axis X'—X' of the table support 20 is at right angles to the axis X—X along which the ink applying and wiping assembly 9 is mounted for movement.

The support 20 essentially comprises two longitudinal members 20A, 20B connected by two cross members 20C, 20D and is supported on a base 30 of the machine frame B through columns 31 which are adjustable in height and inclination by threaded rods 32. The table support 20 comprises two parallel tracks 35, 36 disposed on opposite sides of axis X'—X'. The table frame 21 carrying the actual table 22 is displaceable along tracks 35, 36. For this purpose the table frame 21 comprises at the corners of its rear end rollers 37 for cooperation with the upper sides of the tracks and back-up rollers 38 for cooperation with under sides of the tracks 35, 36. Accordingly, the table frame 20 is displaceable longitudinally but is held vertically relative to the tracks 35, 36. The rollers 37 and 38 are mounted on rear brackets 39. Rear brackets 39 are interconnected by transverse bar 40. The table frame 21 is pivotable about a pivot axis 37A defined by a pair of rollers 37, as will be seen hereinbelow in the description of the operation of the printing machine.

Toward the front, the table frame 21 is associated with the tracks 35, 36 of table support 20 by rollers 41 and back-up rollers 42 carried by front brackets 43. The pair of front brackets 43 are interconnected by a transverse bar 44 pivotally mounted on the brackets 43. At least one link 45 and preferably two links 45 are fixed at lateral sides of the table frame 20, each extending to both sides of an end of the transverse bar 44. The front end of each link 45 is pivotally connected by pin 46 to the table frame 21 and the rear end of each link 45 closer to the transverse bar 44 being pivotally connected by a spindle 47 to yoke 48. The middle of the spindle 47 passes through a yoke 48 attached to the end of a piston rod 49 of a fluid cylinder whose cylinder body 50 is connected to the table frame 21 by a pivot 51.

The table frame 21 thus secured to the table support 20 is coupled for translation by drive means comprising two gears 60, 61 rotatably mounted at the opposite ends of the table support 20 which mesh with the toothed belt 62 to which one bracket 39 is secured at 63 and 64. One of the gears 60, 61, here gear 61, is fixed for rotation with a shaft 65 advantageously driven by a hydraulic motor 66.

The operation of the silk-screen printing machine may be analyzed as follows.

Figure 2:
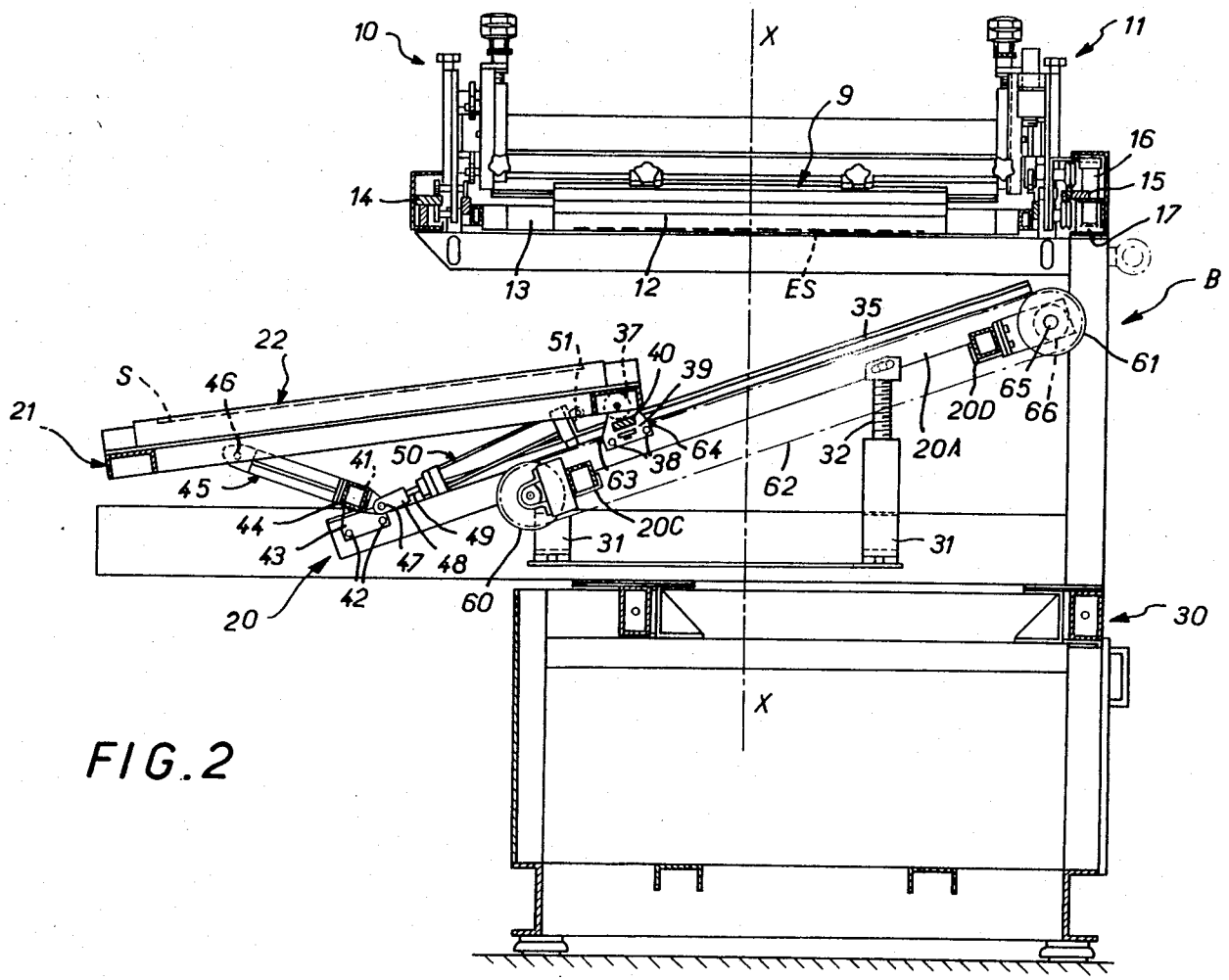
FIG. 2 is a side elevational view taken in the direction of arrow F in FIG. 1, the table being illustrated in its lowered, retracted position.
Figure 3:
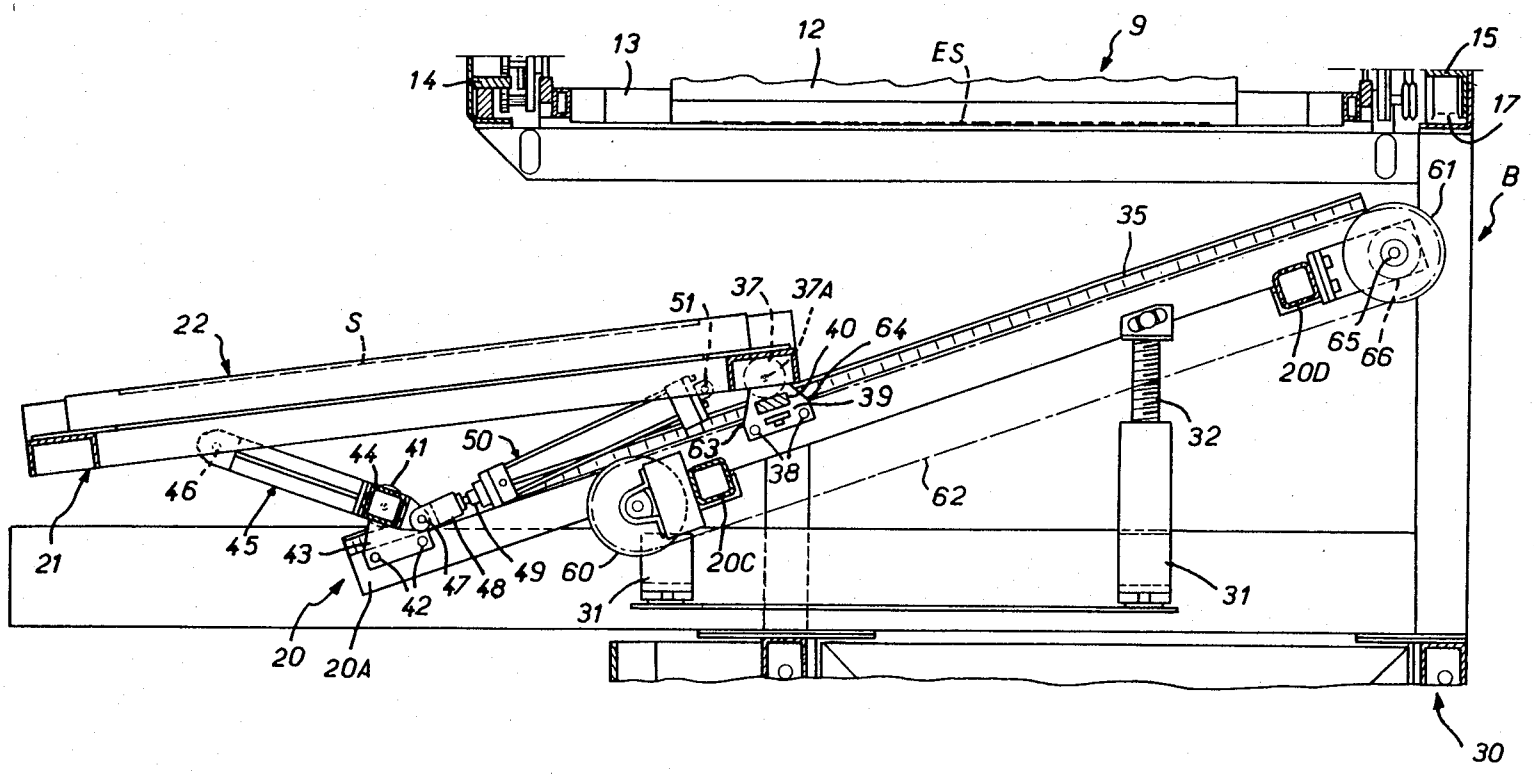
FIG. 3 shows the table and the inclined table support on a larger scale than the preceding views, the table being illustrated in its lowered, retracted position.

In FIGS. 1, 2 and 3 the table 22 is shown in its lowered, retracted position in other words in the position in which the operator may position a substrate to be printed or remove a printed substrate. Thus, as will be clearly understood from these drawings, the greater part of table 22 clears or protrudes outwardly of the machine so that the positioning and removal of the substrate S is considerably facilitated. Moreover, as the table is slightly inclined the substrate has the tendency slide down the table 22 and to be centered by itself by means of the abutments provided for this purpose.

Figure 4:
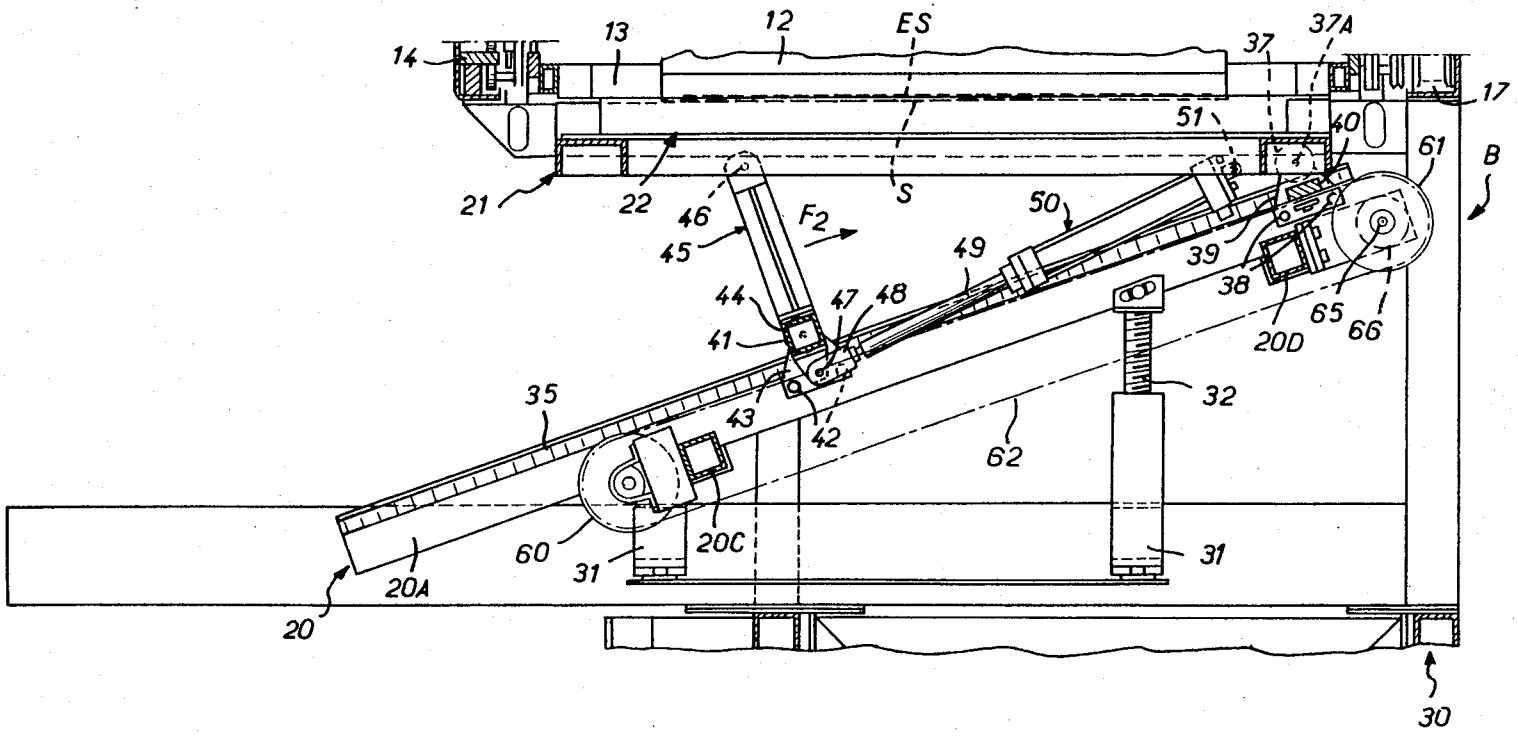
FIG. 4 is a view similar to FIG. 3 in which the table is illustrated in its raised, advanced, printing position.

When the substrate S has been suitably positioned on the table 22 it is held in place by suction means as is known per se, such as a plurality of orifices in the table connected to a source of negative pressure. Then the table 22 is shifted from its lowered, retracted position to its raised, advanced position (FIG. 4) where the substrate S is brought into position parallel to the screen ES and in the immediately therebelow. To this end the hydraulic motor 66 is turned on and the toothed belt 62 translates the table frame 21 and thereby the table 22. At the end of travel, i.e., when the substrate S is in vertical alignment with the screen ES, the fluid cylinder 50 is pressurized so that the links 45 are driven in the direction of arrow F2 with an angular displacement of the table frame 21 about the transverse bar 40.

At the end of the pivotal movement of the table frame 21, the inking applying and wiping assembly 9 is driven for displacement along axis X—X to transfer the image from the screen ES to the substrate S by means of ink-wiping blade 12.

Once the image is printed on the substrate S the pressure in the fluid cylinder 50 is relieved which disengages the substrate from the screen ES and the table frame 21 is returned to its lowered, retracted position, as in FIG. 2, where the operator may easily remove the printed substrate S and replace it with a substrate to be printed, and so on.

It will be noted that during movement of the table 22 to the lowered, retracted position the ink applying and wiping assembly 9 is returned to its initial position during which the ink-applying blade applies ink to the screen ES for the next printing operation.

Obviously, the invention is not intended to be limited to the illustrated and described embodiment but on the contrary will admit of all variations and alternatives understood to those skilled in the art without departing from the spirit and scope of the invention.

What is claimed is:

1. A silk-screen printing machine for printing substrates lying flat, said printing machine comprising a machine frame supporting a screen in a substantially horizontal position, ink-applying blade and an ink-wiping blade moveably mounted on said machine frame for alternately sweeping across said screen, a flat table for receiving a substrate to be printed, wherein the improvement comprises:

a fixed inclined table support generally underlying said screen, means mounting said table on said inclined table support for reciprocatory movement along said table support between a lowered, retracted, access position projecting beyond said machine frame and outwardly of said table support at one side of said screen and a raised, advanced, printing position underlying and aligned with said screen; means for pivotally mounting said table on said table support for movement between a sloping condition at said access position and a substantially horizontal condition parallel to said screen at said printing position; and control means for controlling movement of said table between said raised, advanced, printing position with said table being parallel to and immediately below said screen, and said lowered, retracted, access position for introducing and removing the substrate with a greater part of said table clearing said machine for enhanced acess.

2. The printing machine of claim 1 wherein said table is carried by a table frame, said table support comprising tracks, said table frame being displaceable along said tracks, said means for pivotally mounting said table comprising a pivotal mounting of said table frame about an axis at the rear end of said table frame.

3. The printing machine of claim 2, wherein said table frame comprises means for mounting said table frame at its rear end for movement along said inclined table support.

4. The printing machine of claim 3, wherein said means for mounting said table frame comprises rollers cooperable with the upper side of said tracks and back-up rollers cooperable with the under side of said tracks, said rollers being freely rotatably mounted on a rear pair of brackets, and a rear transverse bar interconnecting said rear brackets.

5. The printing machine of claim 4, said means for mounting said table frame further comprising other rollers and back-up rollers freely rotatably mounted on a pair of front brackets, a front transverse bar interconnecting said front pair of brackets and pivotally mounted thereon.

6. The printing machine of claim 5, wherein said means for controlling movement of said table comprises means for pivoting said table frame including a fluid cylinder comprising a cylinder body and a piston rod, a selected one of the cylinder body and piston rod being fixed at the rear of said table frame and the nonselected one of the cylinder body and the piston rod connected to one end of at least one link fixed to said front transverse bar, the other end of said one link being pivotally connected to said table frame near the front end thereof.

7. The printing machine of claim 4, wherein said means for controlling the movement of said table comprises gears mounted adjacent opposite ends of said inclined table support, a toothed belt running over and meshing with said gears, said toothed belt being secured to said pair of rear brackets on said table frame.

8. The printing machine of claim 1, wherein said inclined table support is supported on four columns fixed to a base of said machine frame.

9. The printing machine of claim 8, wherein said columns comprise means for adjusting the height and inclination of said inclined table support relative to said machine frame.

10. The printing machine of claim 1 wherein said table is carried by a table frame, said table support comprising tracks, said table frame being displaceable along said tracks, said means for pivotally mounting said table comprising a pivotal mounting of said table frame about an axis at the rear end of said table frame.

11. A silk-screen printing machine for printing substrates lying flat, said printing machine comprising a machine frame supporting a screen in a substantially horizontal position, an ink-applying blade and an ink-wiping blade movably mounted on said machine frame for alternately sweeping across said screen, a flat table for receiving a substrate to be printed, wherein the improvement comprises:

an inclined table support including table tracks, a table frame carrying said table, means mounting said table frame on said inclined table support for reciprocating movement along said table tracks between a lowered, retracted, access position projecting beyond said machine frame and outwardly of said table support at one side of said screen and a raised, advanced, printing position underlying and aligned with said screen, means for pivotally mounting said table frame about an axis at one end of the table frame for movement between a sloping condition of said access position and a substantially horizontal condition parallel to said screen at said printing position, and control means for controlling movement of said table between said raised, advanced, printing position with said table being parallel to and immediately below said screen, and said lowered, retracted, access position for introducing and removing the substrate with a greater part of said table clearing said machine for enhanced access.

* * * * *